US007747029B2

(12) United States Patent
Kim et al.

(10) Patent No.: US 7,747,029 B2
(45) Date of Patent: Jun. 29, 2010

(54) SCREEN FOR PLAYING AUDIBLE SIGNALS BY DEMODULATING ULTRASONIC SIGNALS HAVING THE AUDIBLE SIGNALS

(75) Inventors: Jung Ho Kim, Yongin-si (KR); Jun Tai Kim, Yongin-si (KR); Oleg V. Rudenko, Yongin-si (KR); Andrey V. Shanin, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1044 days.

(21) Appl. No.: 11/455,741

(22) Filed: Jun. 20, 2006

(65) Prior Publication Data

US 2007/0154039 A1 Jul. 5, 2007

(30) Foreign Application Priority Data

Jan. 3, 2006 (KR) ..... 10-2006-0000385

(51) Int. Cl.
*H04R 25/00* (2006.01)
*H04R 3/00* (2006.01)

(52) U.S. Cl. ..... 381/152; 381/77

(58) Field of Classification Search ..... 381/77, 381/80, 82, 150, 152, 160, 163, 191, 387
See application file for complete search history.

(56) References Cited

FOREIGN PATENT DOCUMENTS

JP 11-098592 A 4/1999
KR 20-0168498 Y1 11/1999

*Primary Examiner*—Brian Ensey
(74) *Attorney, Agent, or Firm*—Sughrue Mion, PLLC

(57) ABSTRACT

A sound reproduction screen includes: at least one cell including a vibrator which receives and is vibrated by an ultrasonic signal carrying an audible signal, and a medium which has nonlinear response characteristics with respect to a vibration of the vibrator; and a screen containing the at least one cell which is distributed in a matrix structure, wherein the vibrator of the cell includes an elastic body that is vibrated by the ultrasonic signal and reflects the audible signal separated from the ultrasonic signal according to the nonlinear response characteristics of the medium, and an asymmetrical body that is connected with the elastic body and vibrates in the medium.

11 Claims, 7 Drawing Sheets

SCREEN FOR PLAYING AUDIBLE SIGNALS BY DEMODULATING ULTRASONIC SIGNALS HAVING THE AUDIBLE SIGNALS

CROSS-REFERENCE TO RELATED APPLICATION

This application claims priority from Korean Patent Application No. 10-2006-0000385, filed on Jan. 3, 2006, in the Korean Intellectual Property Office, the entire disclosure of which is incorporated herein by reference.

BACKGROUND OF THE INVENTION

1. Field of the Invention

Apparatuses consistent with the present invention relate to demodulating a modulated ultrasonic signal to output an audible signal and playing an original audible signal, and more particularly, to a sound reproduction screen which receives an ultrasonic signal that is modulated to include an audible signal and demodulates the ultrasonic signal via a cell structure having nonlinearity.

2. Description of Related Art

An ultrasonic signal is a sound wave that has a frequency above 20 kHz, which is higher than a frequency of an audible signal. Generally, an ultrasonic signal as described above may not be perceived by humans, but may be modulated and transmitted including an audible signal. In this case, the range of an audible signal is extended in comparison to a general audible signal, and the directivity of a corresponding signal is also improved. Accordingly, an ultrasonic signal as described above is being utilized for various types of ultrasonic speakers.

Since a conventional ultrasonic speaker modulates an audible signal onto an ultrasonic signal and utilizes the modulated ultrasonic signal, the conventional ultrasonic speaker may transmit the modulated ultrasonic signal farther than a loudspeaker outputting a general audible signal and may also improve the directivity of a signal. Also, the conventional ultrasonic speaker operates in such a manner that, as modulated ultrasonic signals are passing through a medium such as air, audible signals from the modulated ultrasonic signals, demodulated due to nonlinear response characteristics of the medium, are output at a certain point. However, since the power of audible signals output at the point is a portion of the power of audible signals carried in ultrasonic signals, the conventional ultrasonic speaker must have a larger output than general loudspeakers. Accordingly, a listener is exposed to a sound field where ultrasonic signals are very powerful and those ultrasonic signals may cause physical harm. In this aspect, users have not readily utilized ultrasonic speakers as a sound source for listening and have utilized general loudspeakers that output frequency signals in an audible frequency band.

Accordingly, the present invention suggests a sound reproduction screen which utilizes a method of transmitting audible signals using ultrasonic signals and also demodulates modulated ultrasonic signals to output audible signals, and a new cell structure included in the sound reproduction screen.

SUMMARY OF THE INVENTION

The present invention provides a sound reproduction screen in which audible signals are demodulated from ultrasonic signals carrying the audible signals via a cell structure including passive devices.

The present invention also provides a sound reproduction screen which includes a new cell structure that can demodulate audible signals included in ultrasonic signals by using nonlinearity characteristics of a particular liquid or gas, and also can provide an ultrasonic conversion and playback efficiency of the sound reproduction screen.

The present invention also provides a sound reproduction screen which can play audible signals carried in ultrasonic signals by installing a plurality of cells on any type of surface, such as a screen and wallpaper, where an image may be displayed, and emitting ultrasonic signals to the surface, from an ultrasonic sound source.

According to an aspect of the present invention, there is provided a sound reproduction screen including: at least one cell comprising a vibrator which receives and is vibrated by an ultrasonic signal carrying an audible signal and a medium which has nonlinear response characteristics with respect to a vibration of the vibrator; and a screen containing the at least one cell which is distributed in a matrix structure, wherein the vibrator of the cell comprises an elastic body that is vibrated by the ultrasonic signal and reflects the audible signal separated from the ultrasonic signal according to the nonlinear response characteristics of the medium, and an asymmetrical body that is connected with the elastic body and vibrates in the medium.

According to another aspect of the present invention, there is provided a sound reproduction screen including: at least one cell provided with a housing body comprising an inlet that receives an ultrasonic signal carrying an audible signal and an outlet that outputs a flow corresponding to the ultrasonic signal, and a medium that has nonlinear response characteristics with respect to an energy of the ultrasonic signal; and a screen containing the at least one cell distributed in a matrix structure, wherein the inlet of the cell reflects the audible signal that is separated from the ultrasonic signal according to the nonlinear response characteristics of the medium of the housing member.

BRIEF DESCRIPTION OF THE DRAWINGS

The above and/or other aspects of the present invention will become apparent and more readily appreciated from the following detailed description of exemplary embodiments, taken in conjunction with the accompanying drawings of which.

DETAILED DESCRIPTION OF EXEMPLARY EMBODIMENTS

Figure 1:
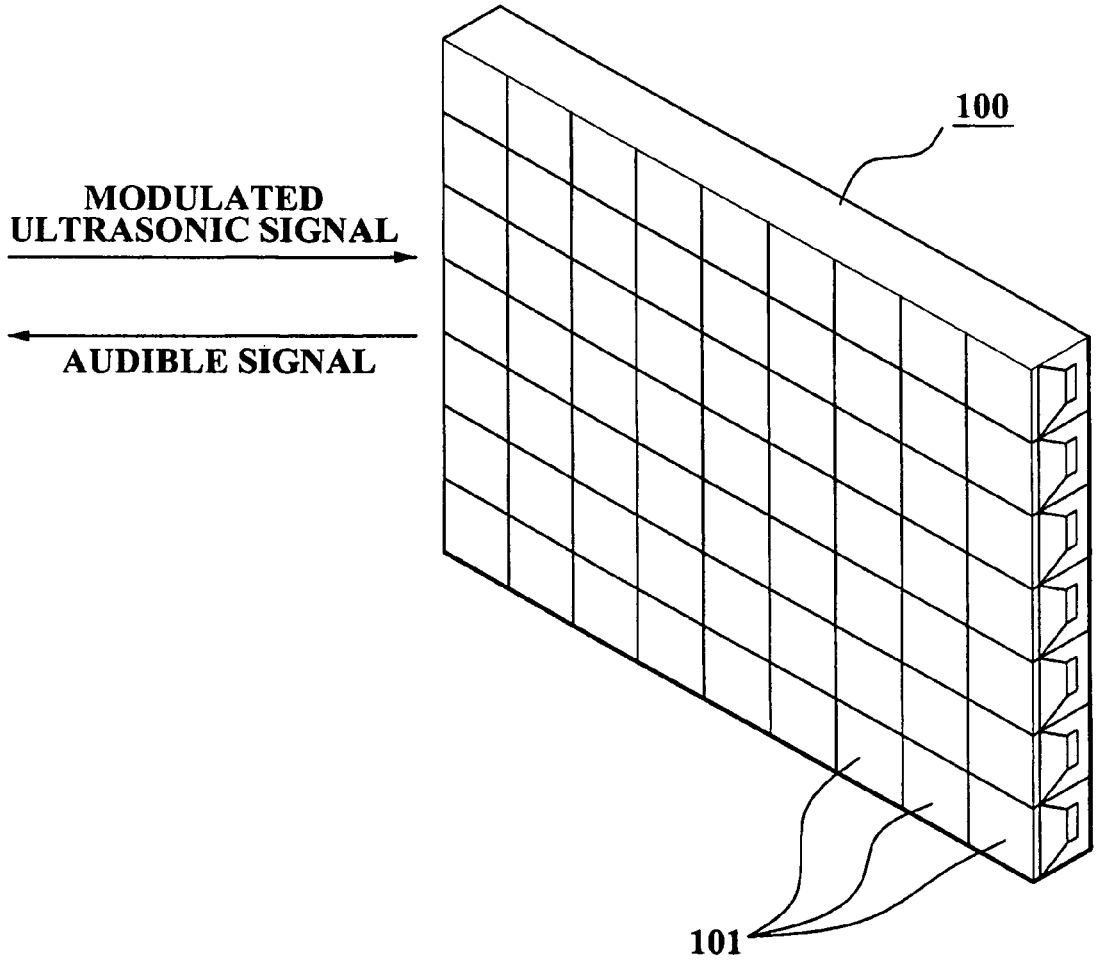
FIG. 1 is a perspective view illustrating a configuration of a sound reproduction screen according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

FIG. 1 is a perspective view illustrating a configuration of a sound reproduction screen according to an exemplary embodiment of the present invention.

A sound reproduction screen 100 according to the present invention includes at least One cell 101. In FIG. 1, the sound reproduction screen 100 is shown with a plurality of cells 101 which are distributed in a matrix structure. An ultrasonic source (not shown) may be provided around the sound reproduction screen 100 to emit ultrasonic signals that are modulated with audible signals. In this instance, the ultrasonic source outputs the modulated ultrasonic signals to the sound reproduction screen 100. The output modulated ultrasonic signals include audible signals and, as an example, may be modulated by an amplitude modulation method.

The at least one cell 101 included in the sound reproduction screen 100 has a predetermined width and area. Modulated ultrasonic signals that have reached the sound reproduction screen 100 are demodulated and reflected by the at least one cell 101 of the sound reproduction screen 100. Reflected signals have a frequency of about 20 Hz to about 20 kHz, which is in an audible frequency band so that humans can hear the demodulated signals as the reflected signals. In this instance, each of the cells 101 (in the matrix structure) of the sound reproduction screen 100 functions as a demodulator which demodulates modulated ultrasonic signals and outputs audible signals.

Modulated ultrasonic signals that are utilized in the sound reproduction screen 100 of the present invention and include audible signals may be output from at least one ultrasonic source and emitted to the sound reproduction screen 100.

Cells included in a general sound reproduction screen may be divided into a passive cell and an active cell. Each cell functions as a transducer that changes ultrasonic signal energy into audible signal energy. Namely, the cell functions as a demodulator that separates audible signals from ultrasonic signals. In this instance, the passive cell indicates a cell that does not need to be supplied with external power for its operation. The cells 101 included in the sound reproduction screen 100 are passive cells.

Also, the cells 101 of the sound reproduction screen 100 may individually operate and also may operate as one unit. When the cells 101 operate as one unit, it may be very advantageous when the sound reproduction screen 100 plays audible signals in a low frequency, for example, in a range of about 20 Hz to about 1 kHz.

Also, the general sound reproduction screen may be divided into a mechanical and electromagnetic principle. When each cell functions as a demodulator, the general sound reproduction screen may separate audible signals from modulated ultrasonic signals according to the displacement of a wave or according to the velocity of a wave. The sound reproduction screen 100 operates according to a mechanical operation principle, and more particularly, each of the plurality of cells 101 operates according to a hydromechanical principle. Also, each of the plurality of cells 101 separates audible signals from modulated ultrasonic signals by using the velocity of a wave.

Hereinafter, a size requirement of each cell so that the sound reproduction screen 100 illustrated in FIG. 1 operates in a matrix structure will be described. In this instance, the entire screen is constructed using cells and a size of a cell indicates the width of: each cell. Generally, an audio frequency band that is audible to humans is between about 20 Hz and about 20 kHz. The minimum wavelength corresponding to the frequency is about 1.7 cm ($\lambda=c/f=340(m/s)/(20\ kHz)$).

In the present exemplary embodiment, when the size of a cell is below about 1 cm, which is a half of the minimum wavelength, the cells are consecutively arranged. However, the size of an actual cell is calculated to be about 1 cm according to a maximum value of the audio frequency band. Assuming that the frequency of an actual audio frequency band is below about 10 kHz, the size of a cell may be about 2 cm.

Figure 2:
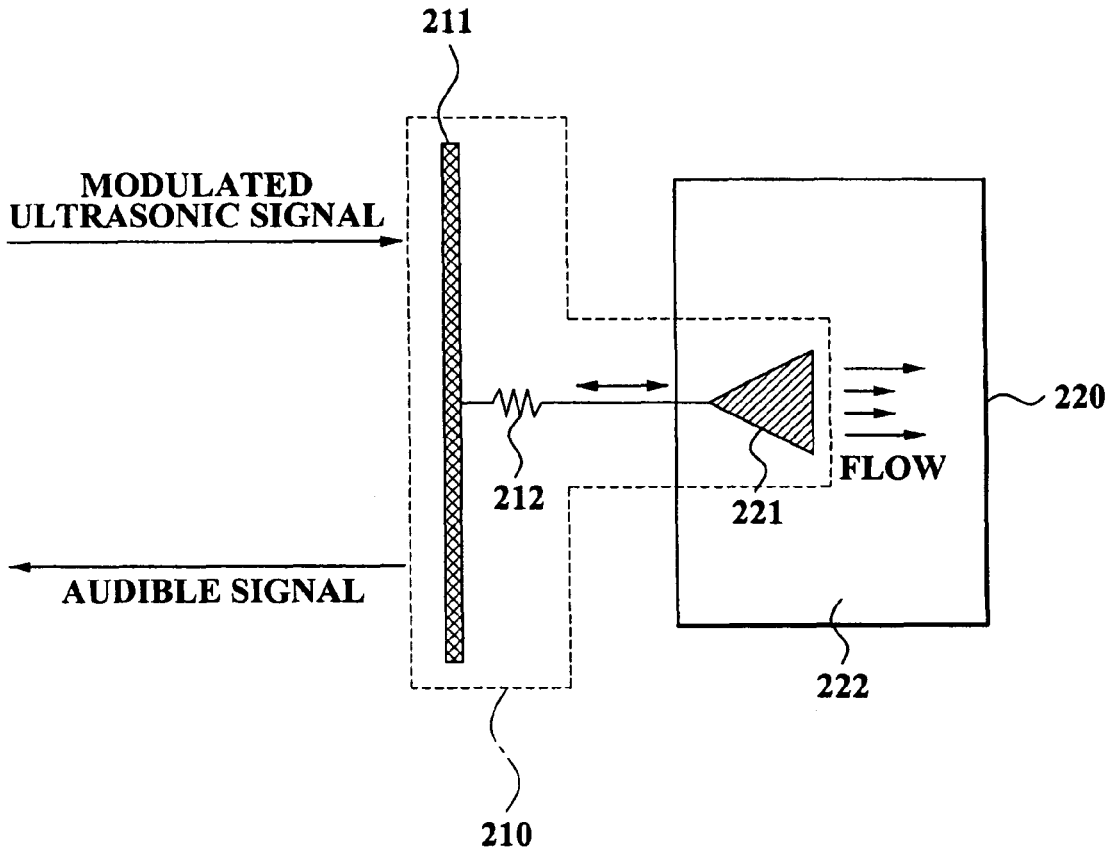
FIG. 2 is a diagram illustrating an example of a hydromechanical cell configuration of a sound reproduction screen according to an exemplary embodiment of the present invention.

FIG. 2 is a diagram illustrating an example of a hydromechanical cell configuration of a sound reproduction screen according to an exemplary embodiment of the present invention.

As illustrated in FIG. 2, when ultrasonic signals are received, a membrane unit 211 of a vibrator 210 vibrates. This vibration is transmitted to an asymmetrical body 221 through a spring unit 212 of a support body that connects the membrane unit 211 and the asymmetrical body 221. A flow occurs in a medium unit 220 containing a predetermined medium 222 due to the vibration. According to the present exemplary embodiment, the medium 222 contained in the medium unit 220 has non-linear response characteristics. According to the present exemplary embodiment, the medium 222 may be a liquid, for example, water. The medium 222 has characteristics that the relationship of a force supplied to the medium 222 of the asymmetrical body (member) 221, according to a velocity change of the wavelength of an ultrasonic signal, is nonlinear. Due to the nonlinearity of the medium 222, each cell may perform an operation analogous to a rectifier. As is known to those skilled in the art, audible signals may be separated from ultrasonic signals through the medium 222 having nonlinearity which is analogous to nonlinear response characteristics of a diode that is utilized in a general electronic circuit.

Figure 5:
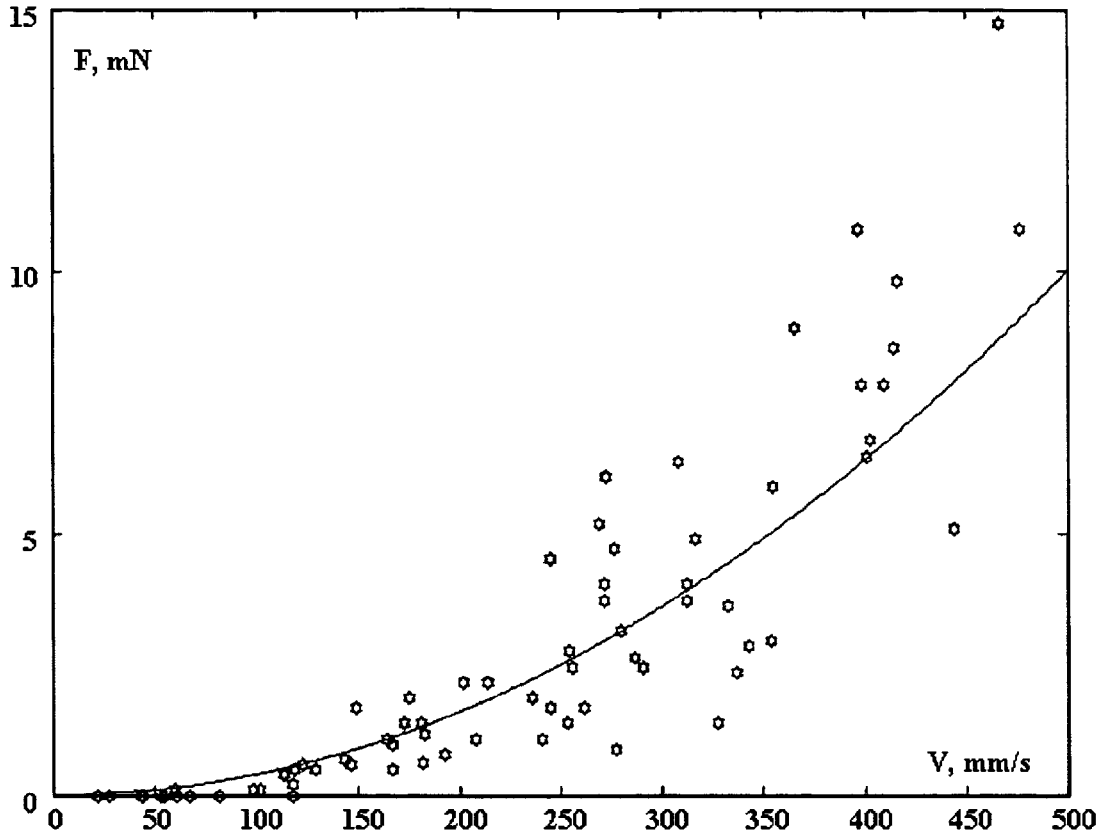
FIG. 5 is a diagram illustrating simulation experimental data analysis results of asymmetrical response characteristics of hydromechanical cells shown in FIG. 2.

Experimental results of nonlinear response characteristics of the hydromechanical cells shown in FIG. 2 with respect to ultrasonic signals carrying audible signals are illustrated in FIG. 5.

FIG. 5 is a diagram illustrating simulation experimental data analysis results of asymmetrical response characteristics of the hydromechanical cells shown in FIG. 2. The experiments shown in FIG. 5 were conducted under the environment described below.

To simulate cells of a sound reproduction screen according to the present invention, the asymmetrical body (member) 221 shown in FIG. 2 has been manufactured in a cone shape of which height is about 1 cm and a conical angle is about 45 degrees. Water was utilized for the medium 222 of the medium unit 220. Also, an actuator connected to the asymmetrical body 221, such as a loudspeaker, was utilized to simulate the membrane unit 211 of the vibrator 210. A scale was provided in a lower portion of the medium unit 220 so as to measure the force of the medium unit 220 with respect to a vibration of the actuator. Based on results of the experiment, it was determined that response results, a y-axis of FIG. 5, of the medium unit 220 with respect to the applied velocity of a wave, an x-axis of FIG. 5, had nonlinear response characteristics.

Figure 3:
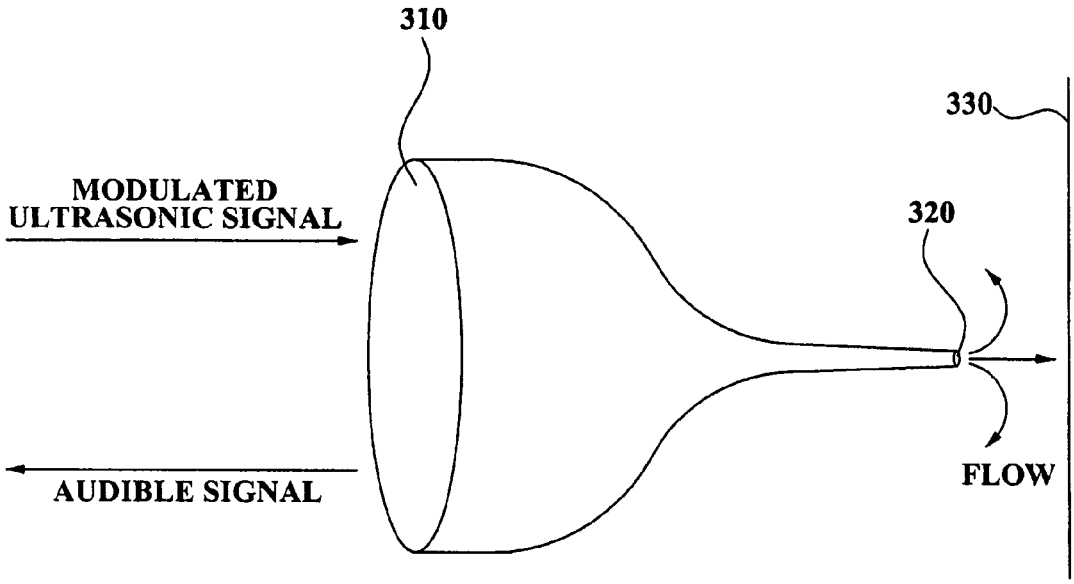
FIG. 3 is a diagram illustrating an example of a hydromechanical cell configuration of a sound reproduction screen according to another exemplary embodiment of the present invention.

FIG. 3 is a diagram illustrating an example of a hydromechanical cell configuration of a sound reproduction screen according to another exemplary embodiment of the present invention.

Referring to FIG. 3, modulated ultrasonic signals carrying audible signals are received in an inlet 310 of a housing member which is in the shape of a horn. The modulated ultrasonic signals reach an outlet 320 and generate a flow in the outlet 320. In this instance, the flow exerts a force on an external wall 330 which is spaced apart from the outlet 320 at a predetermined distance. Also, the modulated ultrasonic signals are reflected as audible signals from the inlet 310 due to the shape of the housing member and the non-linear response characteristics of a medium contained in the housing member. According to the present exemplary embodiment, the medium may be a gas. Due to the shape of the housing member and the medium as described above, a relationship between the velocity chamber of waves of ultrasonic signals and a force applied to the external wall 330 by the flow from the outlet 320 is nonlinear. As well, the hydromechanical cells shown in FIG. 3 may operate analogous to a rectifier due to the nonlinear response characteristics. As is known to those skilled in the art, audible signals may be separated from modulated ultrasonic signals through the medium having nonlinear response characteristics which are analogous to nonlinear response characteristics of a diode the is utilized in a general electronic circuit.

Figure 4:
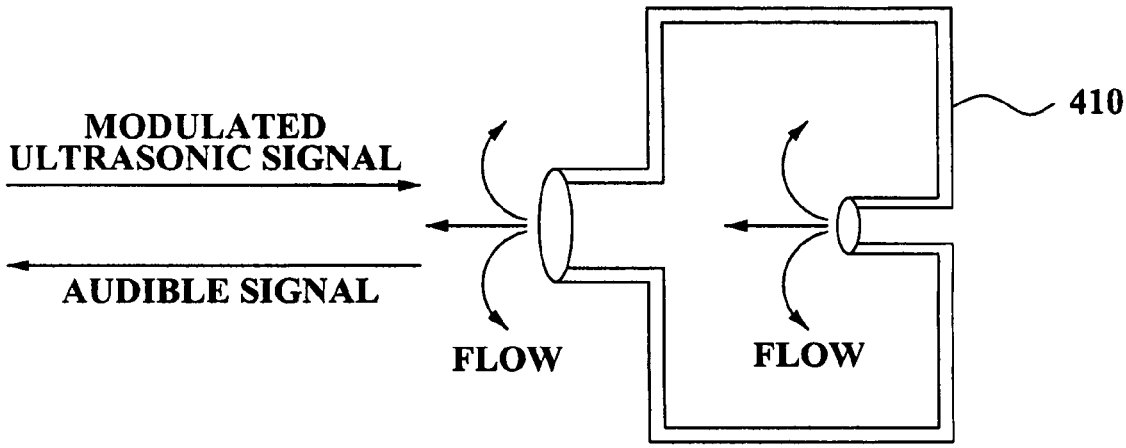
FIG. 4 is a diagram illustrating an example of another hydromechanical cell configuration of the sound reproduction screen illustrated in FIG. 3.

FIG. 4 is a diagram illustrating an example of another hydromechanical cell configuration of the sound reproduction screen illustrated in FIG. 3. The hydromechanical cell configuration of the sound reproduction screen illustrated in FIG. 3 may be embodied in the structure of a Helmholtz resonator 410 as illustrated in FIG. 4. Also, the hydromechanical cell configuration in the structure of a Helmholtz resonator as illustrated in FIG. 4 operates analogous to the hydromechanical cell configuration including a housing member that is in a shape of a horn as illustrated in FIG. 3.

Namely, in FIG. 4, an inlet receiving modulated ultrasonic signals that carry audible signals corresponds to the inlet 310 of FIG. 3, and an outlet provided in the resonator corresponds to the outlet 320 of FIG. 3. As described above, since the hydromechanical cell configuration of the Helmholtz resonator illustrated in FIG. 4 also has nonlinear response characteristics as described in FIG. 3, audible signals may be separated from modulated ultrasonic signals.

Figure 6:
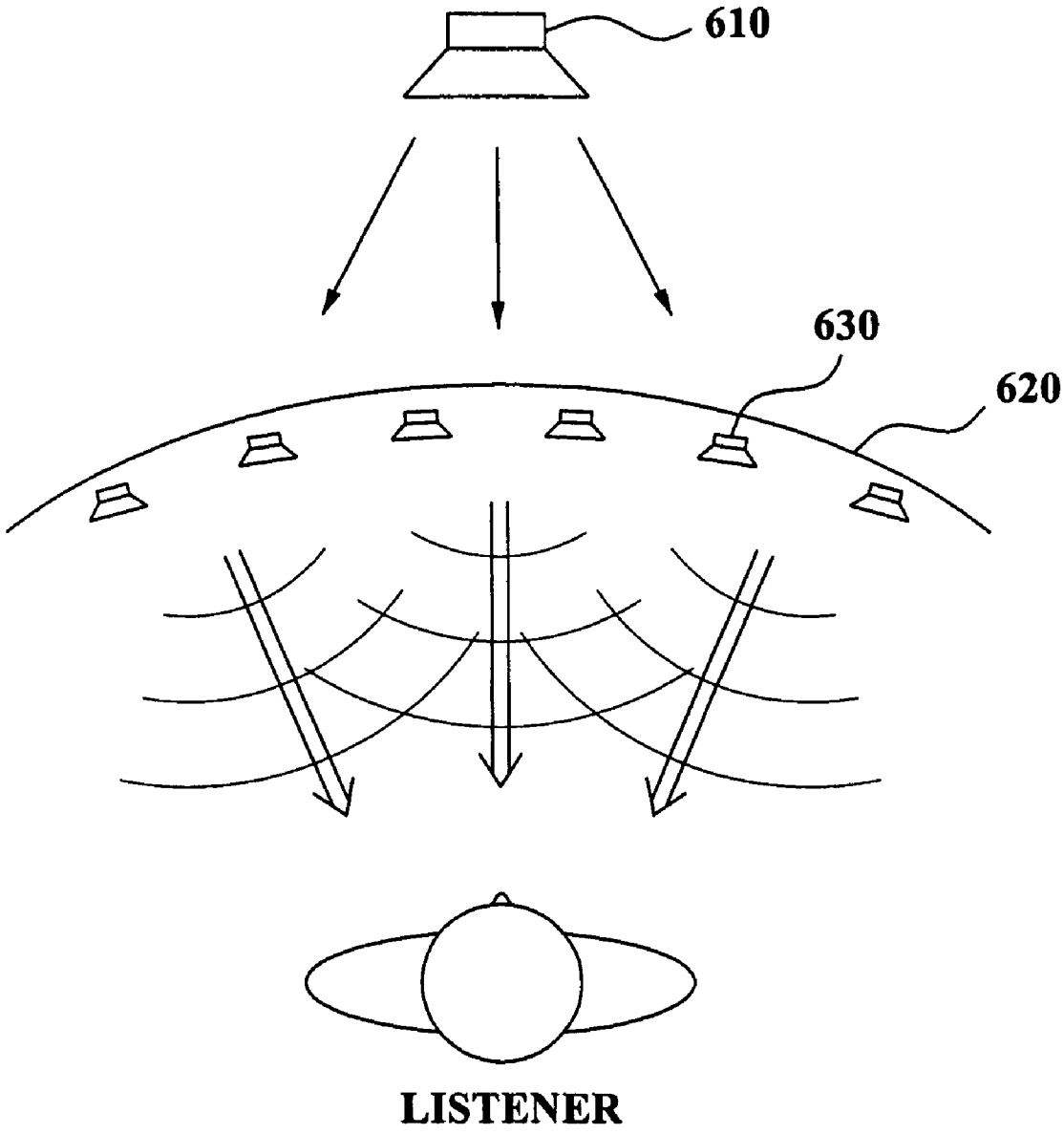
FIG. 6 is a diagram illustrating an example of a three-dimensional sound playback of a sound reproduction screen according to an exemplary embodiment of the present invention.

FIG. 6 is a diagram illustrating an example of a three-dimensional sound playback of a sound reproduction screen according to an exemplary embodiment of the present invention.

A sound reproduction screen 620 illustrated in FIG. 6 may include any type of structure that can be embodied in the shape of a surface around a listener, for example, a wallpaper. As illustrated in FIG. 6, when the sound reproduction screen 620 according to the present invention is embodied as a structure in the shape of a surface around a listener and modulated ultrasonic signals carrying audible signals are outputted from an ultrasonic source 610 and emitted to an arbitrary position of the sound reproduction screen 620, the audible signals are outputted from the position where the modulated ultrasonic signals are received in the sound reproduction screen 620, and the listener can enjoy a three-dimensional sound (surround sound). Also, when the position of the ultrasonic source 610 or an output direction of the modulated ultrasonic signals is appropriately adjusted, a random cell 630 on the sound reproduction screen 620 from which audible signals are outputted may also output audible signals. Through this, a three-dimensional sound may be played.

Figure 7:
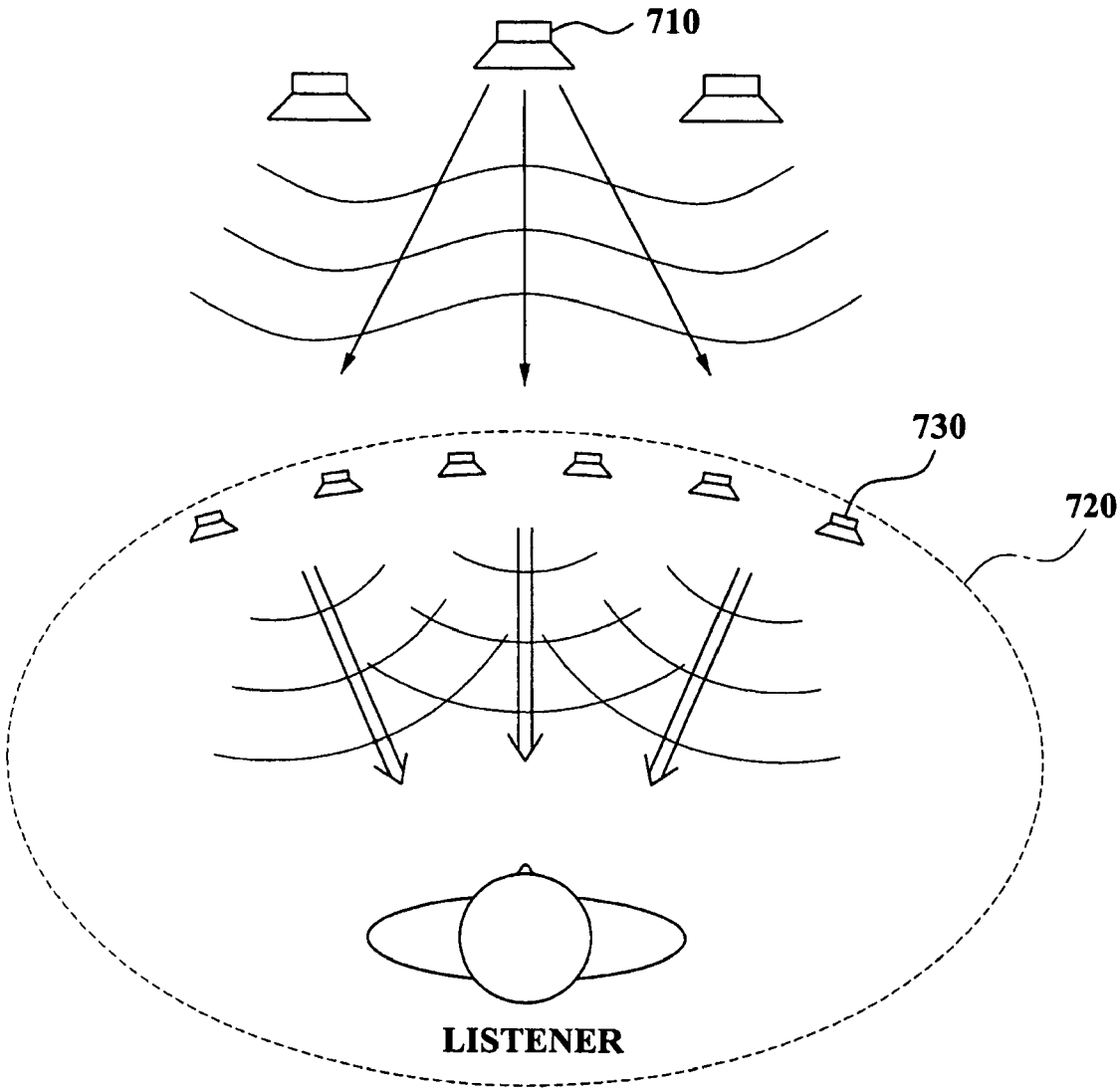
FIG. 7 is a diagram illustrating a sound reproduction screen operating as a secondary sound source according to an exemplary embodiment of the present invention.

FIG. 7 is a diagram illustrating a sound reproduction screen operating as a secondary sound source according to an exemplary embodiment of the present invention.

As illustrated in FIG. 7, when an ultrasonic source 710 is positioned around a sound reproduction screen 720 according to the present invention and modulated ultrasonic signals carrying audible signals are emitted from the ultrasonic source 710, each cell 730 of the sound reproduction screen 720 may operate as a secondary sound source.

The effects as described above may be supported by Huygens-Fresnel principle. According to the Huygens-Fresnel principle, a virtual sound source exists behind a screen and a secondary sound source is generated in front of the screen by the virtual sound source. The secondary sound source may enable the listener to hear sound.

The cell 730 of the sound reproduction screen 720 illustrated in FIG. 7 corresponds to the secondary sound source. Accordingly, in the present invention, a virtual sound source exists behind a screen and an actual sound source, called a cell, exists on the screen. When an amplitude of audible signals and a phase thereof are appropriately calibrated in each cell, the effects when the audible signals reach a listener will be the same. Namely, the listener may feel that the audible signals are transmitted from a virtual sound source existing behind the screen.

Although the exemplary embodiments of the present invention have been described, modifications may be made to these exemplary embodiments without departing from the scope of the present invention.

According to the present invention, there is provided a sound reproduction screen in which audible signals are separated from modulated ultrasonic signals carrying the audible signals via a cell structure including passive devices.

Also, according to the present invention, there is provided a sound reproduction screen which includes a new cell structure that can demodulate modulated ultrasonic signals to separate audible signals included in modulated ultrasonic signals by using the nonlinearity of a particular liquid or gas, and also can provide an ultrasonic conversion and playback efficiency of the sound reproduction screen.

Also, according to the present invention, there is provided a sound reproduction screen which can play audible signals carried in modulated ultrasonic signals by installing a plurality of cells on any type of surface, such as a screen and wallpaper, where an image may be displayed, and emitting modulated ultrasonic signals outputted from an ultrasonic sound source to the surface.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A sound reproduction screen comprising:

at least one cell comprising a vibrator which receives and is vibrated by an ultrasonic signal carrying an audible signal, and a medium unit containing a medium which has nonlinear response characteristics with respect to a vibration of the vibrator, wherein the vibrator comprises an elastic body that is vibrated by the ultrasonic signal and reflects the audible signal separated from the ultrasonic signal according to the nonlinear response characteristics of the medium, and an asymmetrical body that is connected to the elastic body, and is disposed in and vibrates in the medium.

2. The screen of claim 1, further comprising a plurality of cells which are distributed in a matrix structure.

3. The screen of claim 1, wherein the asymmetric body is in the shape of a cone.

4. The screen of claim 1, wherein the medium is a liquid.

5. The screen of claim 1, wherein the vibrator further comprises a spring unit which transfers a displacement of the elastic body and a displacement by a flow of the liquid medium, and the spring unit is disposed between the elastic body and the asymmetrical body.

6. The screen of claim 1, wherein the elastic body is a membrane.

7. A sound reproduction screen comprising:

at least one cell comprising a housing body and a medium, wherein the housing body comprises an inlet that receives an ultrasonic signal carrying an audible signal and an outlet that outputs a flow corresponding to the ultrasonic signal, wherein the medium has nonlinear response characteristics with respect to an energy of the ultrasonic signal, and wherein the inlet of the cell reflects the audible signal that is separated from the ultrasonic signal according to the nonlinear response characteristics of the medium of the housing body.

8. The screen of claim 7, further comprising a plurality of cells distributed in a matrix structure.

9. The screen of claim 7, wherein the housing body is in the shape of a horn and an area of the inlet is larger than the outlet.

10. The screen of claim 7, wherein the housing body is in the shape of a Helmholtz resonator.

11. The screen of claim 7, wherein the medium is a gas.

* * * * *